US005187920A

United States Patent [19]

Focke

[11] Patent Number: 5,187,920

[45] Date of Patent: Feb. 23, 1993

[54] PACK FOR CIGARETTES OR THE LIKE AND PROCESS AND APPARATUS FOR THE PRODUCTION THEREOF

[75] Inventor: Heinz Focke, Verden, Fed. Rep. of Germany

[73] Assignee: Focke & Co., (GmbH & Co.), Verden, Fed. Rep. of Germany

[21] Appl. No.: 690,186

[22] Filed: Apr. 19, 1991

[30] Foreign Application Priority Data

Apr. 26, 1990 [DE] Fed. Rep. of Germany ..... 4013264

[51] Int. Cl.[5] ..... B65B 61/20

[52] U.S. Cl. ..... 53/447; 53/474; 53/157; 53/238

[58] Field of Search ..... 53/156, 157, 209, 238, 53/447, 474

[56] References Cited

U.S. PATENT DOCUMENTS

| | | | |
|---|---|---|---|
| 2,886,234 | 5/1959 | Toensmeier . | |
| 3,454,149 | 7/1969 | Nigrelli | 53/209 |
| 3,673,763 | 7/1972 | Dorfman | 53/209 X |
| 4,299,073 | 11/1981 | Golicz | 53/209 X |
| 4,642,967 | 2/1987 | Culpepper | 55/209 X |
| 4,694,632 | 9/1987 | Gunther, Jr. | 53/209 X |
| 4,912,910 | 4/1990 | Lowe | 53/474 X |
| 4,938,656 | 7/1990 | Gamberini | 53/157 X |
| 5,054,259 | 10/1991 | Miller | 53/157 |

FOREIGN PATENT DOCUMENTS

| | | |
|---|---|---|
| 346026 | 12/1989 | European Pat. Off. . |
| 488769 | 1/1930 | Fed. Rep. of Germany . |
| 508538 | 9/1930 | Fed. Rep. of Germany . |
| 1696067 | 10/1954 | Fed. Rep. of Germany . |
| 1074385 | 1/1960 | Fed. Rep. of Germany . |
| 1144643 | 9/1963 | Fed. Rep. of Germany . |
| 1906965 | 10/1964 | Fed. Rep. of Germany . |
| 1194314 | 6/1965 | Fed. Rep. of Germany . |
| 7119018 | 5/1971 | Fed. Rep. of Germany . |
| 7625899 | 8/1976 | Fed. Rep. of Germany . |
| 7629556 | 9/1976 | Fed. Rep. of Germany . |
| 8002488 | 1/1980 | Fed. Rep. of Germany . |
| 3150447 | 6/1983 | Fed. Rep. of Germany . |
| 3522614 | 1/1987 | Fed. Rep. of Germany . |
| 3819874 | 1/1989 | Fed. Rep. of Germany . |
| 3727489 | 3/1989 | Fed. Rep. of Germany . |
| 585258 | 2/1947 | United Kingdom . |

*Primary Examiner*—John Sipos

*Attorney, Agent, or Firm*—Sughrue, Mion, Zinn, Macpeak & Seas

[57] ABSTRACT

A pack for cigarettes or the like and a process and apparatus for the production thereof is described. Due to several reasons (cigarette) packs quite often have greater (inner) dimensions than the pack contents (cigarette block 23). In order to fill a cavity formed hereby within the pack, a filling piece (39) is provided which is formed from a flat blank (40) by means of folding up outer blank portions. The filling piece is formed to have a three-dimensional shape by means of being displaced in a folding shaft (57) with laterally arranged folding means. The filling pieces (39) produced in this way are conveyed along a filling piece track (78) and are introduced into a block track (79) in transverse direction so they can each be united with a cigarette block (23).

10 Claims, 10 Drawing Sheets

FIG.1A
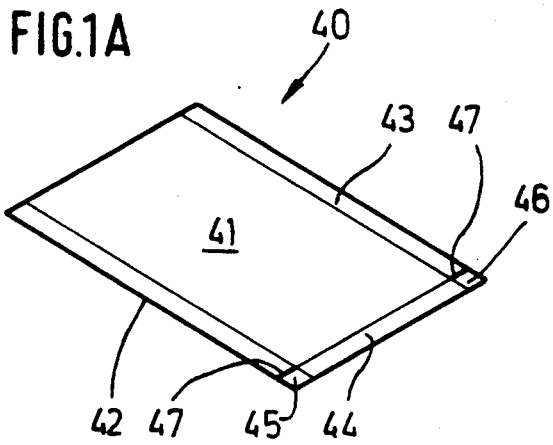
FIG.1D
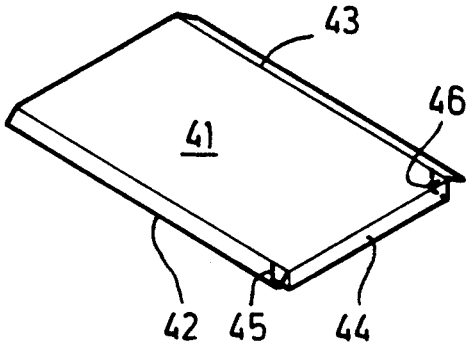
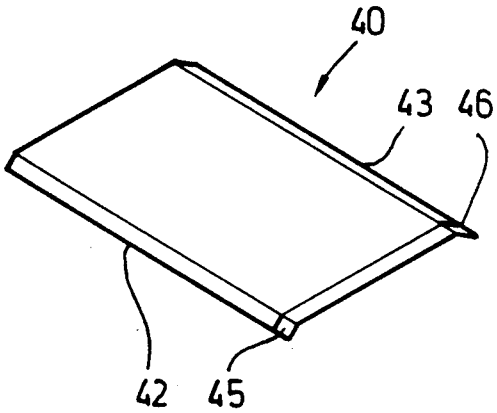
FIG.1B
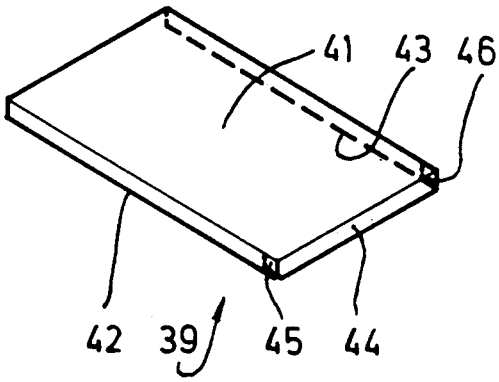
FIG.1E
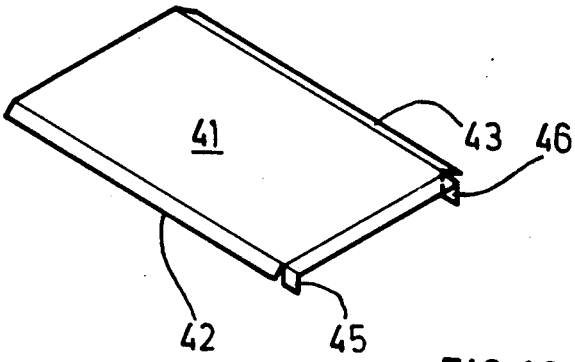
FIG.1C

PACK FOR CIGARETTES OR THE LIKE AND PROCESS AND APPARATUS FOR THE PRODUCTION THEREOF

BACKGROUND OF THE INVENTION

The invention relates to a cuboidal pack made of (thin) cardboard, especially a hinge lid box for accommodating a group of cigarettes wrapped in an inner blank (cigarette block), the dimensions of said group of cigarettes being smaller in depth than the depth of the pack, with a filling piece being arranged in a cavity formed hereby within the pack, said filling piece consisting of (thin) cardboard, and with a filling piece wall abutting the pack contents (cigarette block), and with upright side panels and an upper cross-panel folded transversely relative to said filling piece wall. The invention furthermore relates to a process for producing the filling piece and for introducing the same into a pack. Finally, the invention relates to an apparatus for conducting said process.

Hinge lid boxes are used world-wide as cigarette packs. The structure of this pack type is mostly standardized. This applies to the dimensions as well. Any changes in size have far-reaching consequences. Vending machines for cigarette packs would for instance have to be altered. In some countries, revenue markings are stamped on the packs. The stamping machines are designed for standard pack dimensions.

On the other hand, cigarettes with a substantially smaller diameter than standard cigarettes are increasingly introduced. Consequently, an identical number of such cigarettes forms a pack filling, i.e. cigarette block, with a smaller dimension. The arrangement is mostly such that the cigarette block has a smaller depth then the inner space of the hinge lid box. As a result, a cavity is formed within the pack which is (partially) filled by filling pieces made of foamed material or corrugated cardboard.

Known in the art is also a pack of the aforementioned type, in which the filling piece facing the rear wall consists of three-dimensionally folded (thin) cardboard. The filling piece is part of a blank for a collar which is commonly used with packs of this type. The filling piece is connected with the collar blank and comprises a filling piece wall, transversely folded side panels and an upper cross-panel which is also transversely folded (EP-A-346 026).

By forming a uniform and single-piece blank from collar and filling piece, this known proposal requires a considerable expenditure of material, even more so since the portion of the blank designed for forming the collar is considerably larger than in ordinary packs. Moreover, the production of the pack, especially of the filling piece, and the filling of the pack is more complicated and disadvantageous in terms of machine technics.

Setting out from this state of the art, the invention is based on the object to further develop and improve a pack of the aforementioned kind, such that filling pieces made of folded (thin) cardboard can be simply produced and accomodated in the pack in a material-saving manner.

SUMMARY OF THE INVENTION

To attain this object, the pack according to the invention is characterized in that at least upper corner tabs extending as an extension of the (upper) cross-panel are severed by severing cuts from the adjoining side panels and are folded to a supporting position transverse to the filling piece wall and at right angles to the cross-panel.

The corner tabs and their folding position as taught by the invention effect a significantly higher stability of the filling pieces formed by folded thin cardboard within the pack. In particular, the loading capacity of the upper portion of the filling piece can be increased without any adhesive bonding. The outstanding feature of the invention is that as a result of the folding position of the corner tabs, the upper cross-panel of the filling piece is held in a stable and rigid position. The corner tabs wedged in between the pack contents (cigarette block) and the adjacent pack wall (rear wall) prevent the upper cross-panel from folding back or even just tilting away from the transverse supporting position. Moreover, the corner tabs ensure a particularly stable corner structure of the filling piece.

The filling piece as taught by the invention can be produced by means of a simple process. After a severing cut has been applied between corner tabs and adjoining side panels, the corner tabs are folded to a position transverse to the remaining portion of the blank and to the cross-panel. Then, said cross-panel is folded into the supporting position (transverse to the filling piece wall). Finally, the side panels are folded into the supporting position which is also transverse to the filling piece wall. As a result, the corner tabs are located on the inside of the side panels. When the filling piece is in filling or supporting position within the pack, the width of the filling piece wall corresponds to the width of the cavity which is to be filled. Thus, all folded portions are retained in the proper filling piece position by pack walls and by locking themselves.

According to the invention, the filling pieces are folded from a flat blank, specifically by being moved relative to stationary folding means (folding edges).

After being finished, the filling piece is fed to a preferably rectilinear pack track via a special form-stabilizing filling piece track. The folded filling pieces are held ready in the region of the pack track below the plane of movement of the pack contents (cigarette block) and are taken along therewith to a pack, that is to say to a folding turret. Then, cigarette block and filling piece can be packed in the customary way as a unit, for example in an apparatus according to DE-PS 24 40 006.

Further details of the invention relate to the structure and production of the filling piece and to feeding same to the pack contents. An exemplary embodiment of the filling piece and of an apparatus for producing and installing same are described below in more detail with reference to the drawings, in which:

BRIEF DESCRIPTION OF THE DRAWINGS

FIG. 1*a* to

FIG. 1*e* show folding steps for the production of a filling piece from a blank.

DETAILED DESCRIPTION OF PREFERRED EMBODIMENTS

Figure 2:
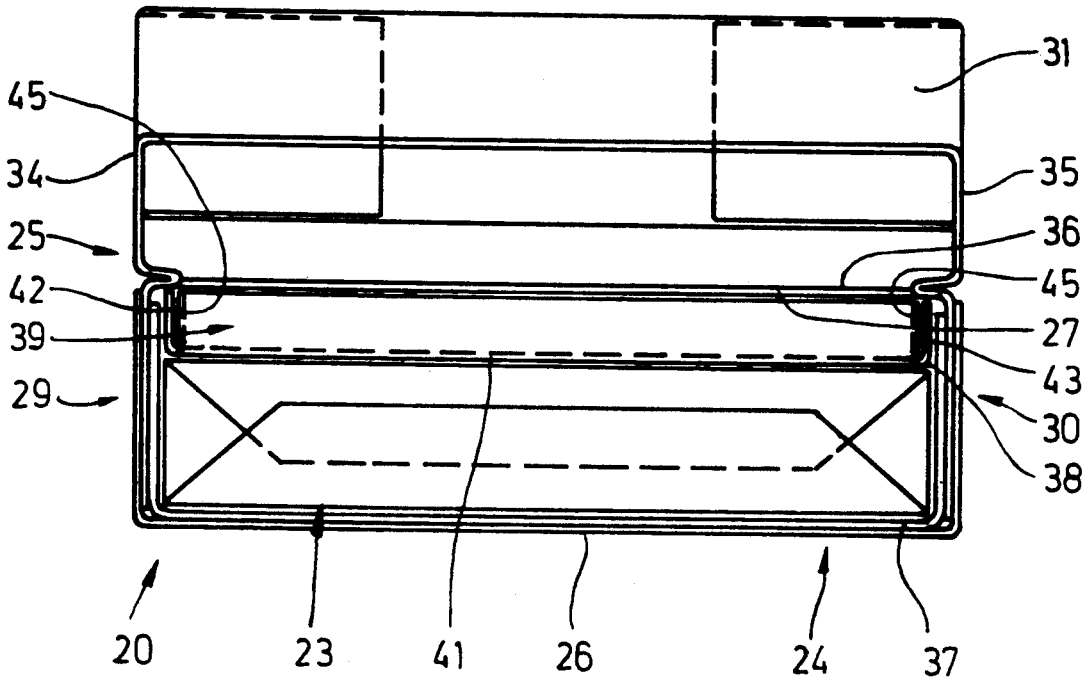
FIG. 2 is a top plan view of an open pack (hinge lid box) with filling piece on a highly enlarged scale.
Figure 3:
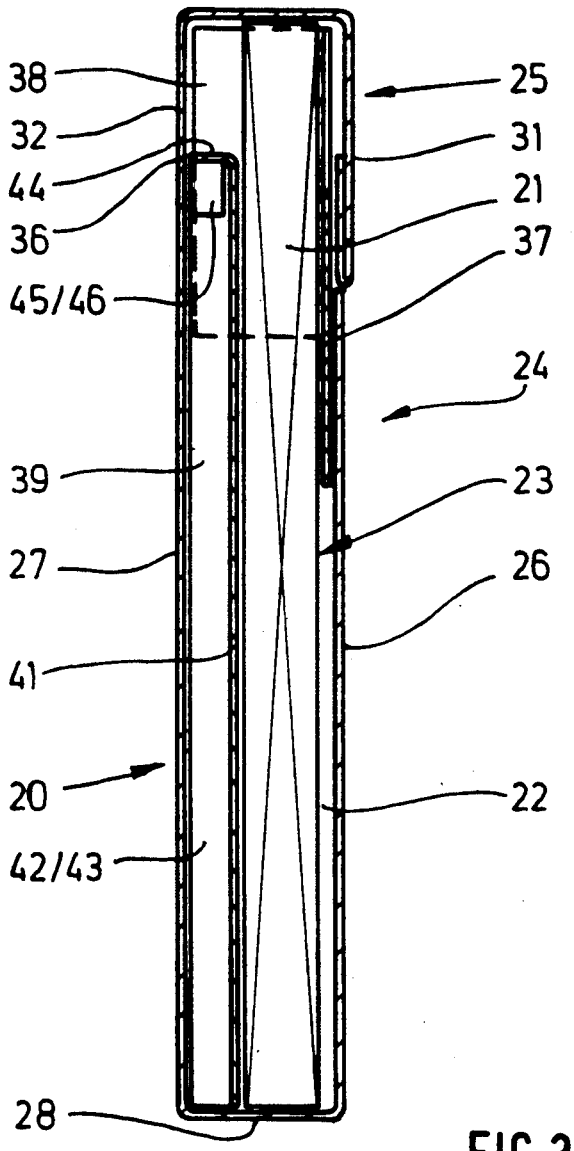
FIG. 3 shows a vertical section of the pack according to FIG. 2 in closed position, on a reduced scale.
Figure 4:
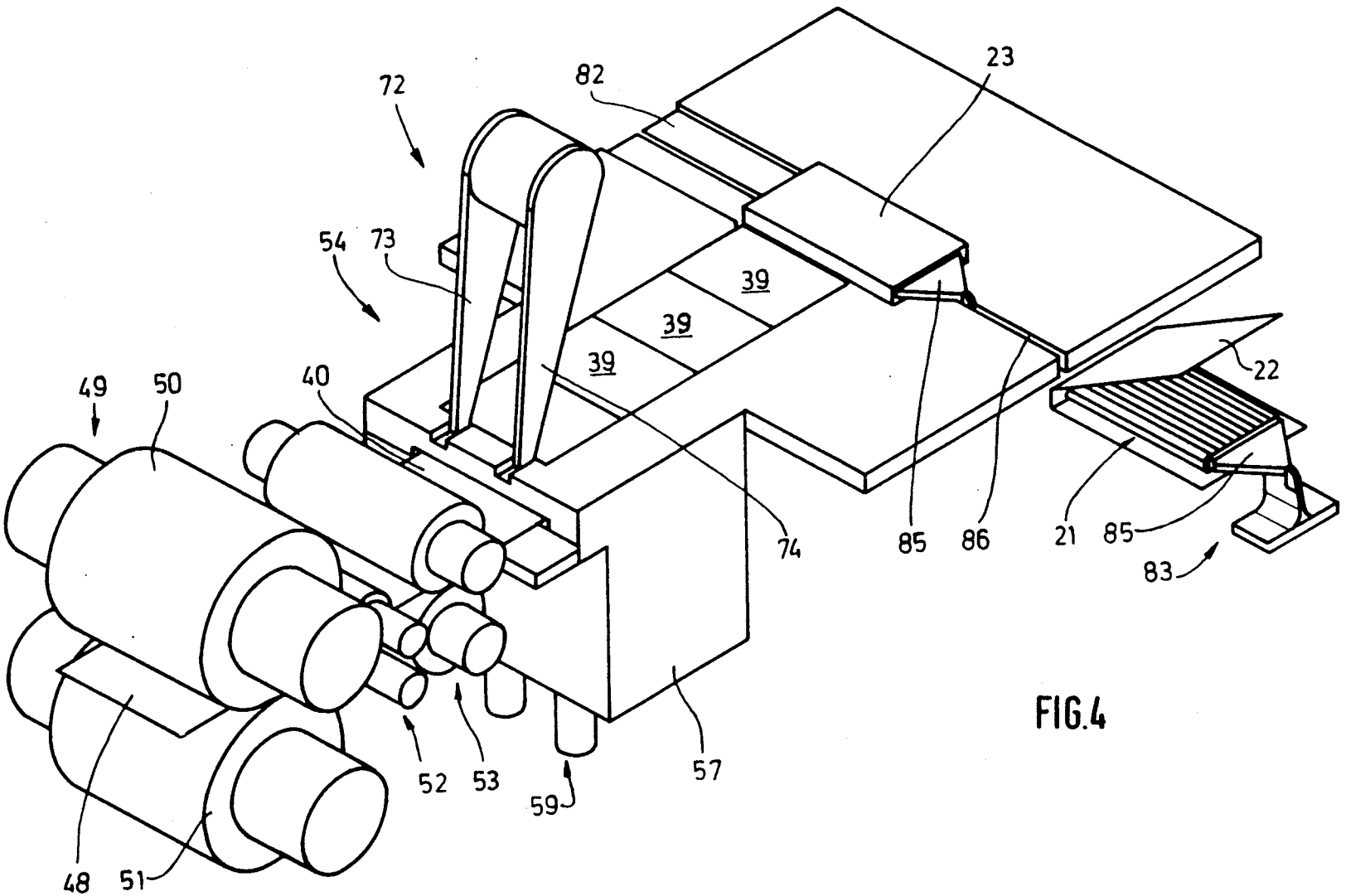
FIG. 4 is a perspective view of details of an apparatus for producing filling pieces and for feeding same to a cigarette block.
Figure 5:
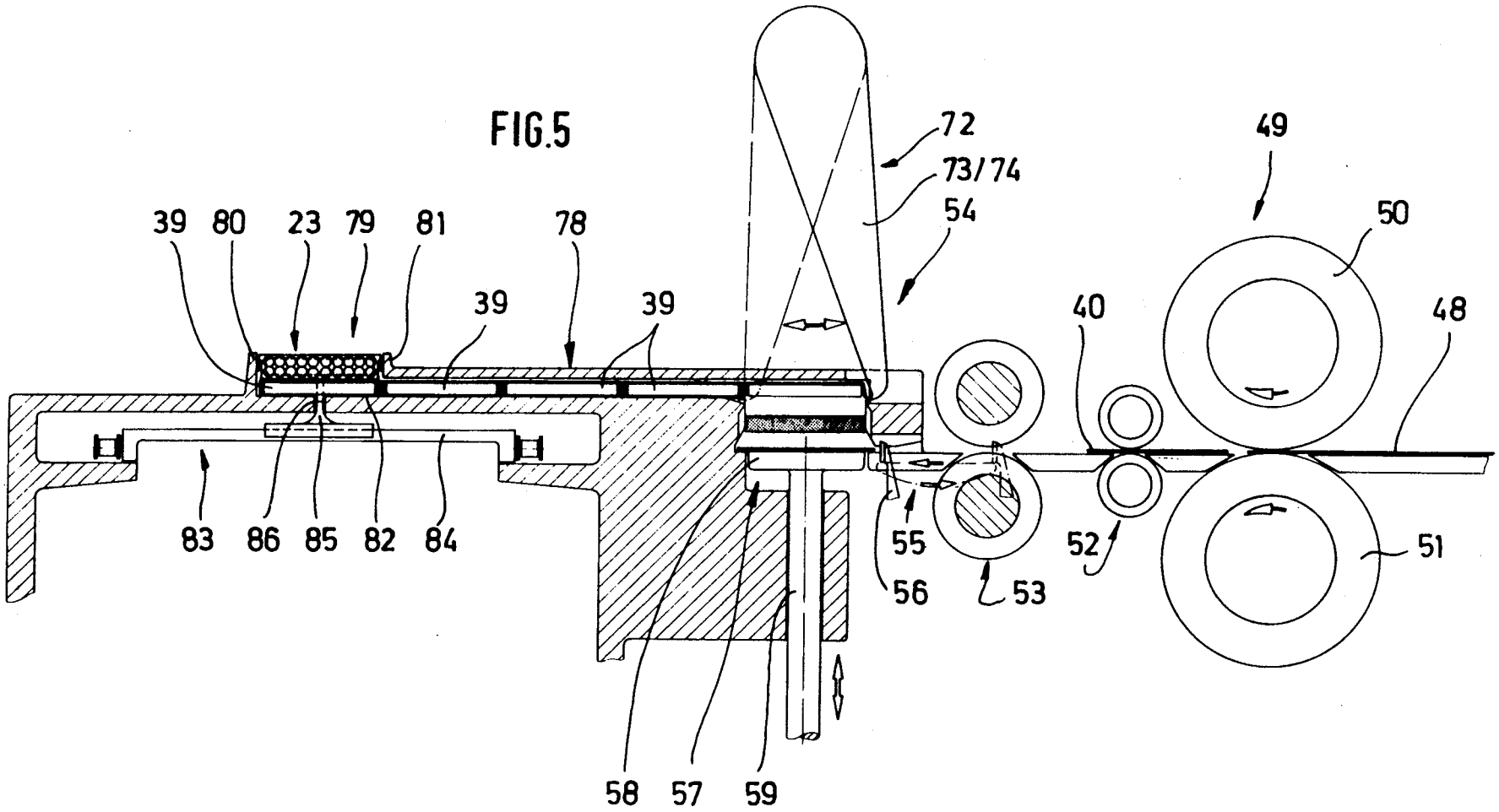
FIG. 5 is a side view and longitudinal section of the apparatus according to FIG. 4.

The drawings relate to details in connection with hinge lid boxes 20, as they are known for accommodating a cigarette group 21. The cigarette group 21 is wrapped in an inner blank 22 made of tin foil or the like. The resulting unit is a cigarette block 23 forming the pack contents.

The pack, i.e. the hinge lid box, consists of a box part 24 and a lid 25 pivotably attached thereto.

The box part 24 comprises a front wall 26, a rear wall 27, a bottom wall 28 and side walls 29 and 30. The lid 25 comprises lid front wall 31, lid rear wall 32, lid top wall 33 and lid side walls 34 and 35. The lid rear wall 32 is connected to the rear wall 27 of the box part via a hinge 36. A standard hinge lid box also comprises a collar 37 which is located in the box part 24 in the region of front wall 26 and side walls 29, 30 and which projects from the box part 24.

The hinge lid box 20 is dimensioned such that the inner space of the box is larger than the dimensions of the pack contents (cigarette block 23), so that a cavity 38 is formed within the hinge lid box. In the present case, the cigarette block 23 is facing towards the front wall 26, so that the cavity 38 is formed in the rear part of the hinge lid box 20. The cavity 38 extends across the full height and width of the hinge lid box.

Within the cavity 38 there is a filling piece 39 for (partially) filling out the cavity 38. In the shown embodiment, the filling piece 39 extends across the full width of the cavity 38, i.e. of the inner space of the hinge lid box 20, but only across part of its height. The filling piece 39, standing on the bottom wall 28, extends (approximately) up to the hinge 36, i.e. approximately across the full height of the rear wall 27. Depth and width of the filling piece 39 correspond to the dimensions of the cavity 38, so that the cigarette block 23 is fixed within the hinge lid box 20 by the filling piece 39.

The filling piece consists of a folded blank 40 made of (thin) cardboard. In the initial position (FIG. 1*a*), the blank (40) has a rectangular shape. Folded to its three-dimensional shape (FIG. 1*e*), the filling piece 39 forms a filling piece wall 41, approximately corresponding to the size of the rear wall 27 (in the hinge lid box 20). On the upright sides of said wall, side panels 42 and 43 being directed transverse to the filling piece wall 41 are formed. The upper limitation consists of a cross-panel 44 which is also folded transverse to the filling piece wall 41. In the present embodiment, side panels 42, 43 and cross-panel 44 are bearing against the rear wall 27 of the hinge lid box 20. The filling piece wall rests against the pack contents.

Corner tabs 45, 46 have a particular significance. They extend as an extension of the cross-panel 44 in the region of the side panels 42, 43. The corner tabs 45, 46 are separated from the side panels 42, 43 by a severing cut 47.

When the filling piece 39 is in its folded three-dimensional shape, the corner tabs 45, 46 have a special function. They are folded into a position transverse to the filling piece wall 41 and transverse to the cross-panel 44 and they rest against the inside of the side panels 42, 43 in the upper region thereof. As a result, the folding position of the corner tabs 45, 46 is stable, as the folded side panels 42, 43 prevent the corner tabs 45, 46 from moving sideways. The corner tabs 45, 46 are not movable in their plane either, since they are bearing with their (upright) edges against the filling piece wall 41 as well as against the rear wall 27. Without adhesive bonding, the filling piece 39 thus receives a stable and pressure-withstanding shape in folded position for accurately positioning and supporting the cigarette block 23 within the larger hinge lid box 20.

The filling piece 39 is produced by folding the blank 40 in simple successive folding steps which are conducted continuously. First, the side panels 42, 43 are folded with the corner tabs 45, 46 to an inclined intermediate position, at an obtuse angle to the plane of the filling piece wall 41 (FIG. 1*b*). Then, the corner tabs 45, 46 are folded to a position transverse to the plane of the filling piece wall 41 and the cross-panel 44 (FIG. 1*c*). Now, the cross-panel 44 is folded to its supporting position (transverse to the filling piece wall 41; FIG. 1*d*). Herewith, the corner tabs 45, 46 reach their final position. Finally, the side panels 42, 43 are folded to their final position transverse to the filling piece wall 41 (FIG. 1*e*).

The filling pieces 39, designed in the described - or in a different - way, are produced and directly conveyed further to the pack, i.e. to the separately produced or prepared cigarette blocks 23, by means of the apparatus shown in the drawings. A unit formed by cigarette block 23 and filling piece 39 is then fed to a packaging machine and introduced into a partially folded hinge lid box 20. The apparatus for producing the hinge lid box 20 may for instance be made like the apparatus shown in DE-A-24 40 006.

The blanks 40 are severed from a continuous web of material 48, specifically by means of a continuously operating punching and embossing unit 49 which consists of punching and embossing rollers 50, 51 between which the web of material 48 is fed through. The blanks 40 severed from the web of material 48 correspond to the embodiment shown in FIG. 1*a*, i.e. they have severing cuts 47 and embossments for folding side panels 42, 43 and cross-panels 44.

The blanks 40 are fed to a folding station 54 by pairs of conveying rollers 52 and 53. The conveying rollers 52 are driven such that they accelerate the severed blanks 40 relative to the web of material 48. The conveying rollers 53 effect another acceleration. For being fed into the folding station 54, the blanks are taken along by a continuously rotating blank conveyor 55 which comprises one (or more) carriers 56 which engage the blanks 40 at their rear side. These carriers 56 are moved along a two-dimensional path underneath the conveying plane of the blanks and with their returning movement move back into initial position.

The blanks 40 are conveyed by the blank conveyor 55 into a folding shaft 57 of the folding station 54. Said folding shaft 57 is (nearly completely) surrounded by walls with folding means. The blanks 40 are each deposited on a lifting plate 58 of an up and downwardly movable stamp 59. The lifting plate 58 is provided with lateral folding edges 60, 61 which in the upward movement of the lifting plate 58 (with blank 40) interact with stationary folding means.

In a first folding step during the continuous and constant upward movement of the lifting plate 58, the side panels 42, 43, including the corner tabs 45, 46, are folded into the inclined position as shown in FIG. 1*b*. For this purpose, inclined folding surfaces 62, 63 are arranged in the lower region of the folding shaft 57 on opposite sides. In the course of the upward relative movement, said lateral portions of the blank 40 are folded around the folding edges 60, 61 into a downwardly directed inclined position. The side panels 42, 43 (including corner tabs 45, 46) laterally project from the effective surface of the lifting plate 58.

As the lifting plate 58 continues to move up, the side panels 42, 43 being in inclined folding position enter the region of an indentation 64, 65 on both sides of the folding shaft 57. The lateral limitations of these indentations 64, 65 are designed such that the side panels 42, 43 slide along upright guide surfaces 66 while maintaining their inclined position.

Next to the indentations 64, 65, namely in the region of the corner tabs 45, 46 which are also projecting from the effective surface of the lifting plate 58, the inclined folding surfaces 62, 63 continue. They merge into upright side faces 67, 68 which are located only in the narrow region of the corner tabs 45, 46. The correspondingly longer folding surfaces 62, 63 cause the corner tabs 45, 46 to fold from the folding position as shown in FIG. 1*b* to the transverse folding position as shown in FIG. 1*c*. In this position, the corner tabs 45, 46 move upward and slide along the side surfaces 67, 68.

A transversely directed inclined folding surface 69 forming a lateral limitation of the folding shaft 57 serves for folding over the cross- panel 44 to the position as shown in FIG. 1*d*. The folding surface 69 extends in the lower region between the side faces 67, 68. This means that the folding step for the cross-panel 44 commences immediately after the corner tabs 45, 46 have been folded to the position as shown in FIG. 1*c*.

The above folding process is finished when the blank 40 reaches the region of further inclined folding surfaces 70, 71. These are arranged as extensions of the guide surfaces 66 for the side panels 42, 43 and cause the (inclined) side panels 42, 43 to fold over into their final position as shown in FIG. 1*e*. These folding surfaces 70, 71 reduce the folding shaft 57 in its upper region to the dimensions of the folded filling piece 39. The folded lateral blank portions surround the edges of the lifting plate 58.

The ready-folded filling pieces 39 are conveyed by the stamp 59 to an upper slide-off position. They are located in the path of movement of a slide means. In the shown embodiment, a slide lever 72 which is movable to and fro, i.e. pivotable, is provided. Here, this slide lever 72 has a double-arm design with two spaced apart webs 73, 74 for commonly engaging the filling pieces 39 at their rear side in slide-off direction. The lower ends of the slide lever 72 or the webs 73, 74 thereof have a hook-like shape, so that a lower short leg 75 engages and supports the filling pieces 39 at their bottom side while they are discharged.

Figure 6:
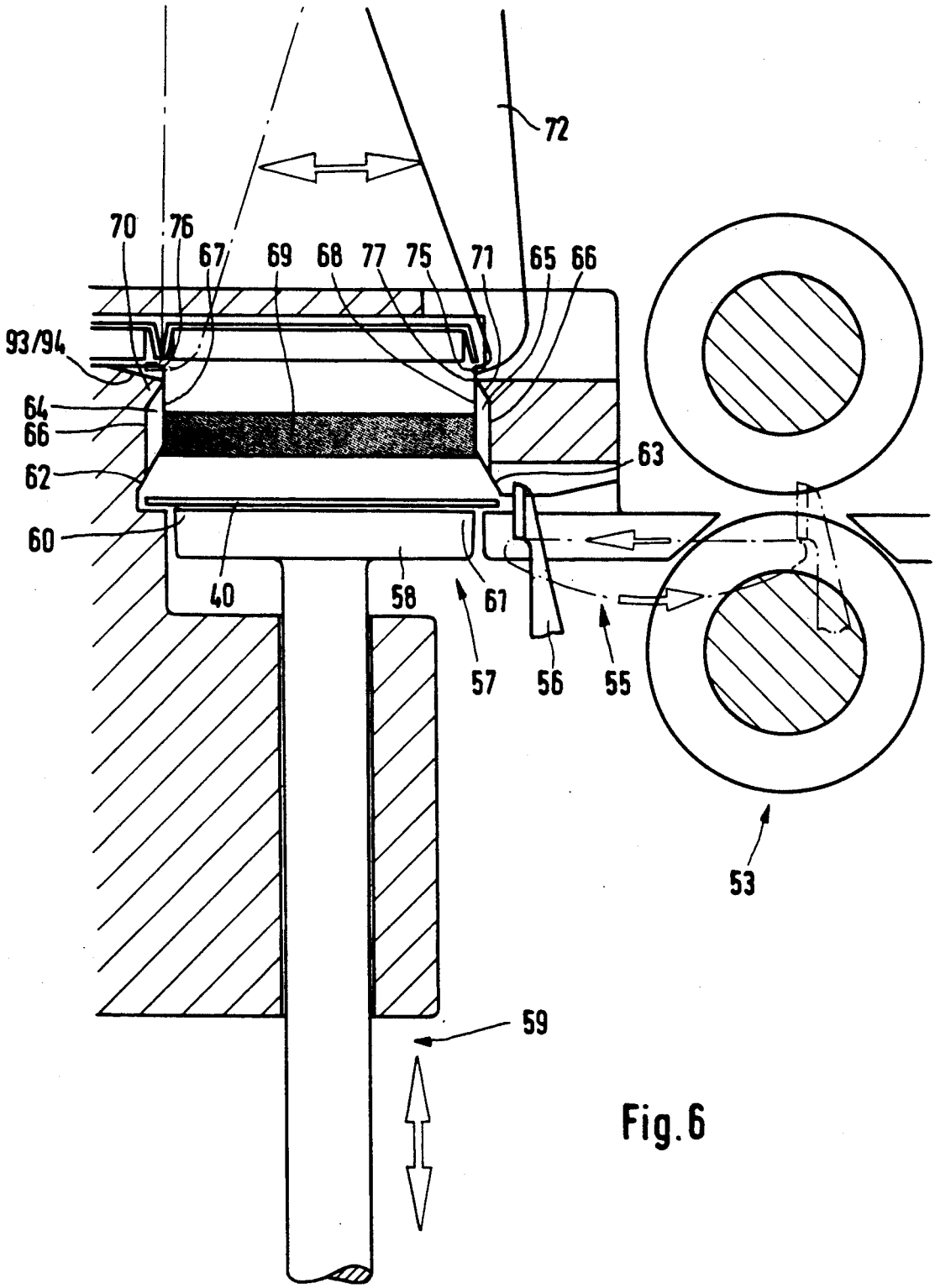
FIG. 6 shows a detail of the apparatus according to FIG. 5 on an enlarged scale.
Figure 7:
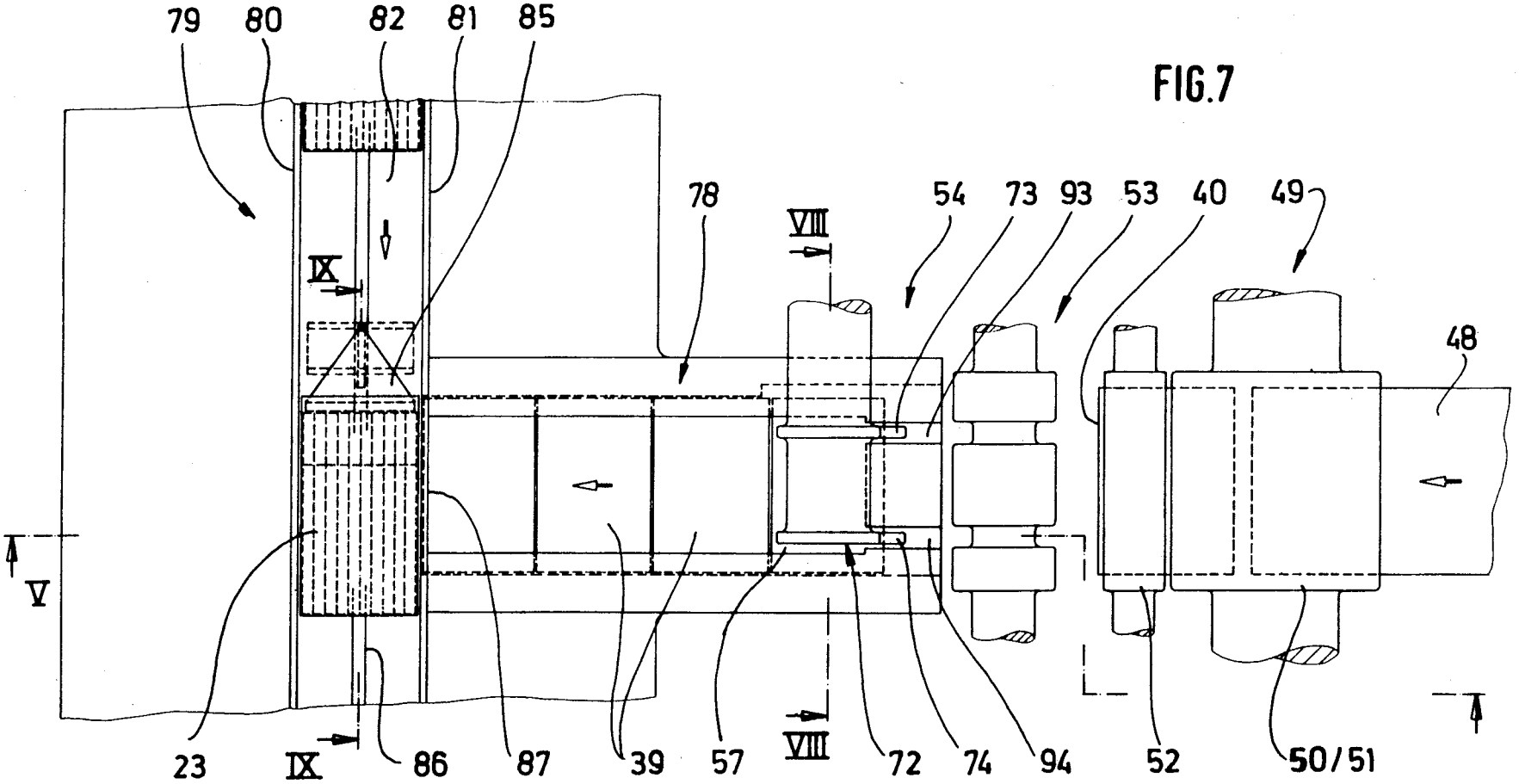
FIG. 7 is a plan view of the apparatus according to FIG. 5.
Figure 8:
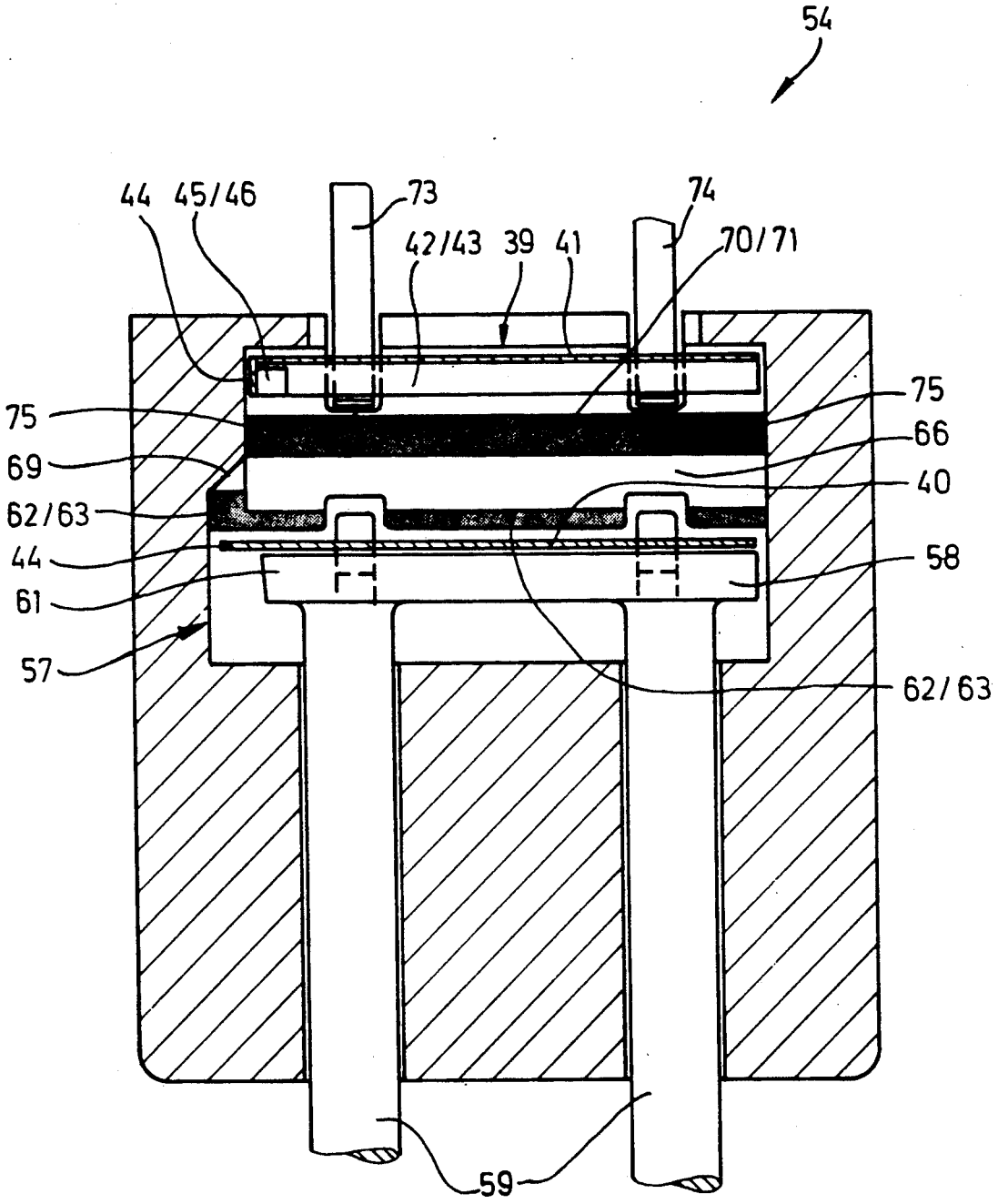
FIG. 8 is a cross-section of the apparatus taken along line VIII—VIII of FIG. 7, on an enlarged scale.
Figure 9:
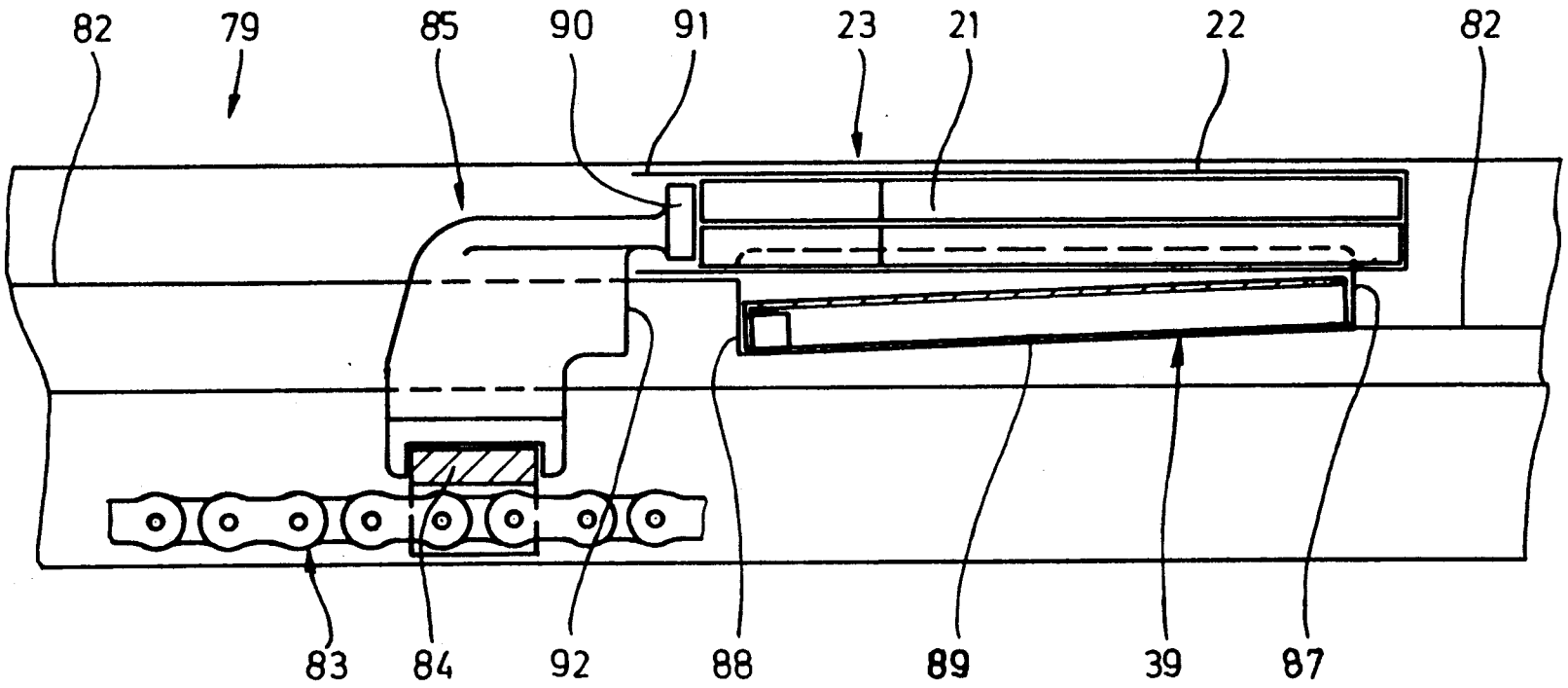
FIG. 9 is a longitudinal section of a conveying track for cigarette blocks taken along the line IX—IX in FIG. 7.

The slide lever 72 can be moved by one conveying cycle at a time, each cycle corresponding to the width of a filling piece 39 (measurement in the direction of discharge). In this process, lower parts of the webs 73, 74 of the slide lever 72 enter slot-like recesses 93, 94 of the lateral limitations of the folding shaft 57, specifically on both opposite sides of the folding shaft 57. After each slide cycle, the upper part of the folding shaft 57 becomes vacant, so that the described folding process can again be conducted with the following blank after the stamp 59 has been lowered. As a result of the restoring stress of the material in the folded portions of the filling pieces 39, the side panels 42, 43 are in a slightly inclined position (FIG. 6) in which they bear against supporting edges 76, 77 at the upper end of the folding shaft 57. Thus, the stamp 59 can be moved downwards without taking along the filling piece.

The filling pieces 39 are conveyed by the slide lever 72 from the region of the folding shaft 57 into a filling piece track 78 consisting of a channel which has the same cross-sectional dimensions as the filling piece 39 and which is preferably closed on all sides. As a result, the folded filling pieces 39 are secured in folded shape during transport. Transport is conducted in cycles by one filling piece 39 at a time. A tightly arranged row is pushed forward, with a new filling piece 39 being pushed into the filling piece track 78 by the slide lever 72.

The filling piece track 78 extends transversely to a block path 79 which serves for (continuously) transporting the pack contents, i.e. in this case cigarette blocks 23. The block track 79, which in the present embodiment is upwardly open, is limited by lateral track guides 80, 81. A rotating conveyor is operating in the region of a track bottom 82, namely a chain conveyor 83 having carriers 85 arranged on traverses 84, said carriers engaging the rear side of one pack filling (cigarette block 23) at a time. The carriers 85 pass through a long slot 86 in the track bottom 82.

The filling piece track 78 laterally opens out into the block track 79, specifically with a track opening 87 having a greater vertical dimension than the filling piece 39. The block track 79 is designed such that up to the track opening 87 for the filling pieces 39, the track bottom 82 is located on a raised level, such that the incoming cigarette blocks 23 can be conveyed over and across the respective filling piece 39 in the region of the track opening 87. Here, the track bottom 82 forms a step 88 which the filling piece 39 abuts. The track bottom 82 is downwardly offset in the vertical direction in this region and forms an inclined surface 89 on which the filling piece 39 rests in a respective position, namely at an acute angle relative to the plane of movement of the cigarette block 23, rising in the conveying direction. The arrangement has been designed such that the filling piece rests below the plane of the track bottom 82 with the side (cross-panel 44) which is pointing towards the incoming cigarette block 23. The oppositely situated side of the filling piece 39 lies with its upper side directly in the plane of movement of the cigarette block 23 so that the filling piece 39 can be taken along by the continuously conveyed cigarette block 23 without jamming.

Figure 10:
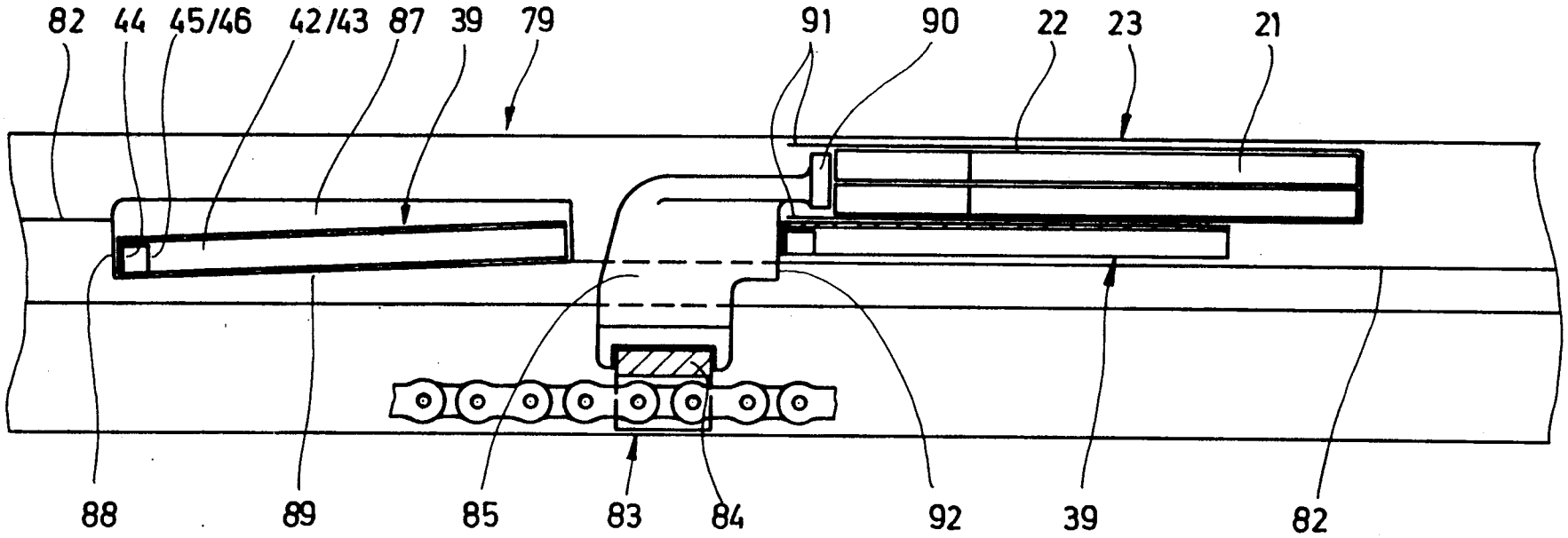
FIG. 10 shows a view in analogy to FIG. 9, but with a different relative position.

In the shown embodiment, the filling piece 39 is engaged below the cigarette block 23 by the carrier 85 of the chain conveyor 83 which is assigned to the cigarette block 23. Then, the unit consisting of cigarette block 23 and filling piece 39 is conveyed by the carrier 85 (FIG. 10).

The carrier 85 is designed in a special way. A ram head 90 engages the rear side of the cigarette block 23 or cigarette group 21. At this point, the cigarette block 23 is not yet finally folded. Rearward folding tabs 91 serving for forming an upper end fold of the inner blank 22 still project from the rear of the cigarette block 23. In the region of the path of movement of the filling piece 39, the carrier 85 is provided with a carrier surface 92 which is offset to the rear with respect to the conveying direction. This carrier surface 92 engages the filling piece 39 during transport in a rearwardly offset position relative to the cigarette block 23. Only when the folding tabs 91 are folded or thereafter, the filling piece 39 is moved to its proper pack position by means of a displacement relative to the cigarette block 23. In this position, the filling piece 39 is flush with the limitation (bottom side) of the cigarette block 23 which is lying in front with respect to the conveying direction.

What is claimed is:

1. A process for introducing filling pieces and cigarette blocks into packs, each pack containing a cigarette block whose dimensions are smaller in depth than a depth of the pack, comprising the following steps:

a) conveying the filling pieces (39) along a filling piece track (78) in a tight arrangement;

b) folding said filling pieces into three dimensional shapes that correspond in size to the difference between the depths of the pack and the cigarette block;

c) continuously conveying the cigarette blocks (23) in a conveying direction along a longitudinally extending block path (79) in a spaced arrangement and in a plane of movement;

d) holding ready each filing piece (39) below the plane of movement of the cigarette blocks (23);

e) moving each filling piece (39) into the block path (79) in a direction transverse to the block path (79), so that the filling piece is taken along by a cigarette block (23), thus forming a unit consisting of a cigarette block (23) and a filling piece (39); and conveying the unit into a box (20).

2. The process as claimed in claim 1, wherein the filling piece (39) comprises a filling piece wall (41) and, connected thereto, a projecting cross-panel (44); and further comprising the step of causing the filling piece to be taken along by the cigarette block (23) in such a way that the filling piece wall (41) rests against the cigarette block (23), and the cross-panel (44) projects outwardly away from the cigarette block (23).

3. The process as claimed in claim 2, further comprising the step of causing the cross-panel (44) to come to rest transverse to the conveying direction and rearwards with respect to the conveying direction.

4. An apparatus for introducing filling pieces into packs, each pack containing a cigarette block whose dimensions are smaller in depth than a depth of the pack, each filling piece and cigarette block of a pack being conveyed separately and being combined into a unit which is further conveyed, said apparatus comprising:

a) means for folding said filling pieces into three dimensional shapes that correspond in size to the difference between the depths of the pack and the cigarette block;

b) a longitudinally-extending block track (79) for conveying cigarette blocks (23) in a conveying direction; and c) a filling piece track (78) for conveying the filling pieces in a tight arrangement and in a direction transverse to said conveying direction;

d) wherein the block track (79) has a track bottom (82) which defines a plane of movement for the cigarette blocks (23) and on which the cigarette blocks (23) are conveyed; and e) wherein the filling piece track (78) has a lateral track opening (87) which opens into the block track (79) so that the filling pieces enter the block track (79) below said plane of movement of the cigarette blocks (23).

5. The apparatus as claimed in claim 4, wherein said track bottom (82) of said block trap (79) has, in a region laterally adjoining said filling piece track (78), a downwardly inclined step (88) which extends transversely to said conveying direction of the block track (79), and against which the filling pieces (39) abut in order to be taken along by the cigarette blocks (23).

6. The apparatus as claimed in claim 4, wherein said block track (79) has, below said plane of movement, an inclined surface (89) which merges in said conveying direction into said track bottom (82), and on which the filling pieces (39) are deposited in order to be taken along by the cigarette blocks (23).

7. The apparatus as claimed in claim 4, wherein said track bottom (82) of said block track (79) is downwardly offset, in a region of said filling piece track (78), for a further common conveyance of the filling pieces (39) with the cigarette blocks (23).

8. The apparatus as claimed in claim 4, wherein the track bottom (82) has, in a laterally adjoining region of said filling piece track (78), a downwardly inclined step (88) followed by a downwardly offset portion of said track bottom (82) followed by an adjoining upwardly directed inclined surface (89) in the conveying direction.

9. The apparatus as claimed in claim 4 or 6, further comprising an endless conveyor (83) having a carrier (85) wherein the cigarettes blocks (23) are continuously conveyable along the block track (79) in spaced arrangement, and wherein each cigarette block (23), together with an associated filling piece (39), is engageable at a rear side thereof by said carrier (85) of an endless conveyor.

10. The apparatus as claimed in claim 9, further comprising a ram head (90) on said carrier (85), wherein said carrier (85) has a carrier surface (92) which is offset to the rear, in a direction opposite to said conveying direction, relative to said ram head (90), wherein each cigarette block (23) is engageable by said ram head (90) of the carrier (85), and wherein the associated filling piece (39), which is offset relative to the cigarette block (23) with respect to a final position in the pack, is engageable by said offset carrier surface (92).

* * * * *